US007545276B2

(12) United States Patent
Shionoiri et al.

(10) Patent No.: US 7,545,276 B2
(45) Date of Patent: Jun. 9, 2009

(54) SEMICONDUCTOR DEVICE

(75) Inventors: Yutaka Shionoiri, Kanagawa (JP); Kiyoshi Kato, Kanagawa (JP); Shunpei Yamazaki, Tokyo (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 418 days.

(21) Appl. No.: 11/518,512

(22) Filed: Sep. 11, 2006

(65) Prior Publication Data

US 2007/0063920 A1 Mar. 22, 2007

(30) Foreign Application Priority Data

Sep. 13, 2005 (JP) ..... 2005-266122

(51) Int. Cl.
*G08B 13/14* (2006.01)

(52) U.S. Cl. ..... 340/572.1; 340/572.7; 257/499

(58) Field of Classification Search ..... 340/572.1, 340/572.7, 572.8; 257/314, 499, 716
See application file for complete search history.

(56) References Cited

U.S. PATENT DOCUMENTS

| | | | | |
|---|---|---|---|---|
| 7,230,580 | B1 * | 6/2007 | Kelkar et al. | 343/870 |
| 2003/0228719 | A1 | 12/2003 | Koizumi et al. | |
| 2005/0045729 | A1 * | 3/2005 | Yamazaki | 235/492 |

FOREIGN PATENT DOCUMENTS

| | | |
|---|---|---|
| JP | 2004-014956 | 1/2004 |
| WO | WO-2005-093647 | 10/2005 |

* cited by examiner

*Primary Examiner*—Toan N Pham
(74) *Attorney, Agent, or Firm*—Eric J. Robinson; Robinson Intellectual Property Law Office, P.C.

(57) ABSTRACT

The present invention provides a semiconductor device including an antenna, and at least a first integrated circuit and a second integrated circuit which are connected to the antenna, wherein the first integrated circuit includes a memory circuit which memorizes a first identification code and a first program for controlling an operation of the first integrated circuit, and wherein the second integrated circuit includes a memory circuit which memorizes a second identification code and a second program for controlling an operation of the second integrated circuit.

44 Claims, 10 Drawing Sheets

SEMICONDUCTOR DEVICE

BACKGROUND OF THE INVENTION

1. Field of the Invention

The present invention relates to a semiconductor device which is capable of inputting and outputting information without contact (is capable of inputting and outputting information with wireless communication).

2. Description of the Related Art

Radio Frequency Identification System (also referred to as RFID system, RFID) in which read and write information can be conducted using an electric wave or an electromagnetic wave without contact has been developed as an identification and authentication technology, which is substitute for barcodes, in industry. In recent years, without being limited to such applications, RFIDs are used for new services such as commodity management in supermarkets, management for checked baggage of air passengers, etc. Like this, such new services are being developed.

A wireless IC (an integrated circuit which can conduct wireless communication) used in RFID technology, including an antenna is several ten millimeter in size, and conducts transmission and reception of information by wireless communication with a reader/writer device. The wireless IC has various shapes such as a label type, a tag type, a card type, a coin type or a stick type.

Such wireless ICs are manufactured with use of miniaturization technology in which an integrated circuit is formed on a silicon wafer and which has been developed so far. For popularization of RFIDs, a cost of a wireless IC which is a core device of the RFIDs is required to be reduced, and thus, reduction of the chip size is made progressively. Further, a method in which a silicon wafer is sectioned and a minute semiconductor chip is mounted has been developed (for example, Reference 1: Japanese Patent Laid-Open No. 2004-14956)

SUMMARY OF THE INVENTION

However, conventional wireless ICs in which antennas and IC chips are combined have been tried to be miniaturized or formed at lower cost for the widespread thereof. Further, because the conventional wireless ICs each have one IC chip, the capacity for storing information is so small that high functionality or multifunction is hindered.

The present invention has been made in view of the above problems. It is an object of the present invention to provide a semiconductor device which can process information without contact. The semiconductor device can process a lot of information and can respond to multifunction. Further, it is another object of the present invention to improve reliability of a semiconductor device which can process information without contact.

The present invention relates to a semiconductor device including a plurality of integrated circuits sharing an antenna as an input-output means. ICs are integrated circuits which can conduct wireless communication, and in each of the integrated circuits, a communication circuit, a logic circuit and a memory circuit can be included. Also, the communication circuit can include a high frequency circuit, a modulation circuit and a demodulation circuit. Also, the memory circuit can include a nonvolatile memory and read only memory. The plural integrated circuits can have the same communication frequency. In addition, the plural integrated circuits may have the same communication frequency but different communication protocols.

One feature of the present invention is a semiconductor device including an antenna; and a plurality of integrated circuits which are connected to the antenna, wherein the plurality of integrated circuits memorize an identification code of individual data.

One feature of the present invention is a semiconductor device including an antenna; and a plurality of integrated circuits which are connected to the antenna, wherein each of the plurality of integrated circuits includes a memory circuit which memorizes a program for controlling an operation of the integrated circuit.

One feature of the present invention is a semiconductor device including an antenna; and a plurality of integrated circuits which are connected to the antenna, wherein at least one of the integrated circuits includes a memory circuit which memorizes a program regarding unencrypted communication; and wherein another one of the integrated circuits includes a memory circuit which memorizes a program regarding encrypted communication.

One feature of the present invention is a semiconductor device including an antenna; and a plurality of integrated circuits which are connected to the antenna; and a majority circuit which is connected to the plurality of integrated circuits, wherein each of the plurality of integrated circuits includes a memory circuit which memorizes a program for controlling an operation of the integrated circuit, wherein the majority circuit outputs an identification code which is a majority value of a plurality of identification codes, from the plurality of identification codes in accordance with communication of the plurality of integrated circuits, and wherein the antenna outputs a carrier wave modulated in response to the identification code.

The antenna of the present invention may be formed over a different substrate from the plurality of integrated circuits.

In addition, in the present invention, a shape of the antenna may be a loop shape or a spiral shape.

In addition, in the present invention, the plurality of integrated circuits may be disposed to be overlapped with the antenna.

In the present invention, the plurality of integrated circuits do not necessarily overlap with an antenna, and they may be disposed inside the antenna (inside a space surrounded by the antenna).

In the present invention, the structure in which the integrated circuits are not overlapped with the antenna does not include connection portions between the antenna and the integrated circuits.

In this specification, an identification code is signals for identifying individual data. An identification code of individual data refers to as an identifier information, an identification code, or an identification data.

One feature of the present invention is a semiconductor device including an antenna; and a plurality of integrated circuits (at least a first integrated circuit and a second integrated circuit) which are connected to the antenna, wherein each of the plurality of integrated circuits includes a memory circuit which memorize an identification code and a program for controlling an operation of the integrated circuit, wherein the identification code is different in each of the plurality of integrated circuits, and wherein the program is different in each of the plurality of integrated circuits.

One feature of the present invention is a semiconductor device including an antenna; and a plurality of integrated circuits (at least a first integrated circuit and a second integrated circuit) which are connected to the antenna, wherein each of the plurality of integrated circuits includes a memory circuit which memorize an identification code and a program for controlling an operation of the integrated circuit, and wherein at least two integrated circuits selected from the plurality of integrated circuits have the same identification code and the same program.

In the present invention, each of the plurality of integrated circuits is formed over different substrates.

In this specification, "to be connected" is synonymous with "to be electrically connected". Thus, an element may be disposed between one connection end and the other connection end.

In accordance with the present invention, a plurality of integrated circuits sharing an antenna are provided, different programs are memorized in memories of the integrated circuits, and thus a semiconductor device of the present invention can be used at the same time for plural applications. The present invention can provide a semiconductor device which can input and output information without contact (which can input and output information with wireless communication).

In accordance with the present invention, a semiconductor device can have redundancy against a breakdown or destruction of an integrated circuit by providing a plurality of integrated circuits which memorize the same identification code, thereby providing a higher resistance.

DETAILED DESCRIPTION OF THE INVENTION

EMBODIMENT MODES

Embodiment Mode 1

Embodiment Mode 1 will describe one mode of a semiconductor device having an antenna and a plurality of integrated circuits with reference to drawings. In particular, a semiconductor device having a plurality of integrated circuits having the same circuit configuration (for example, an IC chip or an LSI chip) is described.

Figure 1:
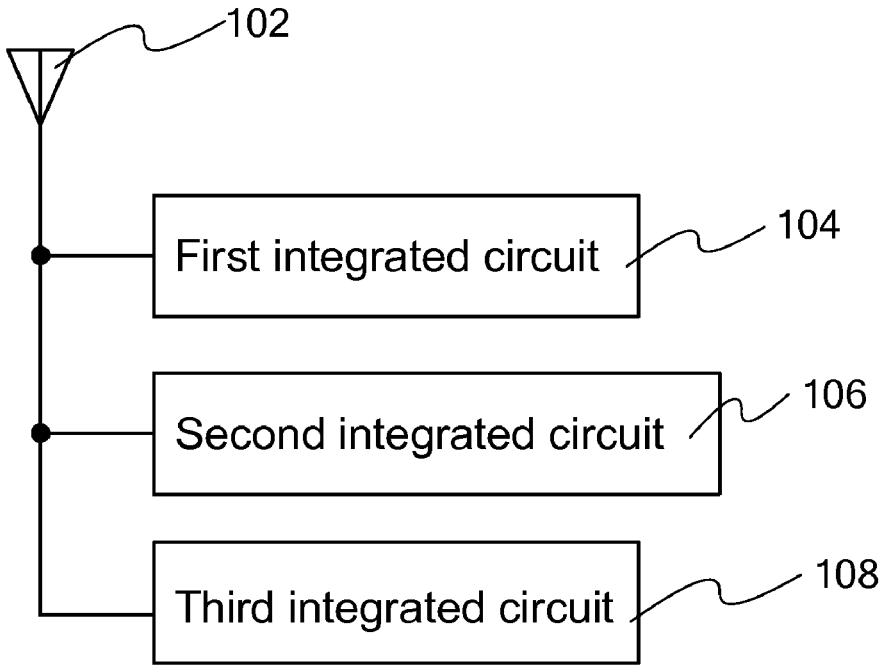
FIG. 1 shows a structure of a semiconductor device in accordance with Embodiment Mode 1.

FIG. 1 shows a structure of a semiconductor device in which an antenna is connected to a plurality of integrated circuits which can input and output information without contact (which can input and output information by wireless communication). In FIG. 1, a first integrated circuit 104, a second integrated circuit 106 and a third integrated circuit 108 are connected to an antenna 102.

Figure 2:
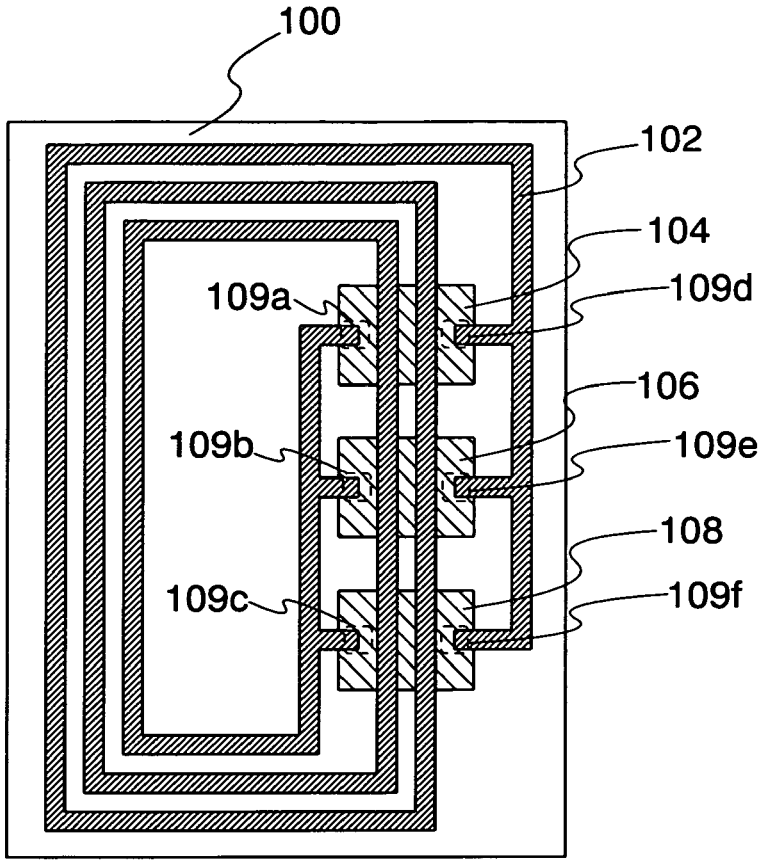
FIG. 2 shows a structure of a semiconductor device in accordance with Embodiment Mode 1.

FIG. 2 gives the structure of FIG. 1 into shapes. FIG. 2 shows a semiconductor device 100 in which the first integrated circuit 104, the second integrated circuit 106 and the third integrated circuit 108 are connected to the antenna 102 through the connection portions 109*a* to 109*f*. The antenna 102 can have a different mode depending on a frequency of wireless communication. As the antenna 102 of FIG. 2, a spiral antenna is shown as a magnetic-field type antenna which can respond to a frequency band from HF band to UHF band (typically 13.56 MHz). Besides, as the magnetic field type antenna, a loop antenna or a helical antenna can also be used. When a communication frequency of a microwave band is employed, a dipole antenna or a patch antenna can be used.

As for the spiral antenna, since impedance of an antenna is different depending on the number of winding or an inside area of the antenna, the antenna is preferably set such that the effective antenna lengths for the first integrated circuit 104, the second integrated circuit 106 and the third integrated circuit 108 connected to the antenna 102 become equal to each other.

When the antenna is observed from a side almost parallel to a central axis of a coil, it may have any shapes such as a circle, a square, a triangle, and a polygon. FIG. 2 shows a structure in which all corner portions (concave corner portions) of the antenna are almost 90°; however the present invention is not limited to this structure. The corner portions (concave corner portions) of the antenna may be rounded. In addition, in the corner portions (concave corner portions) of the antenna shown in FIG. 2, a chamfered shape made by cutting a right-angled triangle may be employed.

As the integrated circuits connected to the antenna 102, an integrated circuit formed on a semiconductor substrate (silicon wafer), an integrated circuit formed using a single crystalline semiconductor layer or a polycrystalline semiconductor layer formed over an insulating surface, or the like may be employed. For example, in a case of an integrated circuit formed using a single crystalline or a polycrystalline semiconductor layer which has a thickness of 200 nm or less, the integrated circuit is fixed on a flexible substrate together with an antenna, thereby giving the semiconductor device flexibility.

As shown in FIG. 2, as the integrated circuits connected to the antenna 102 such as the first integrated circuit 104, the second integrated circuit 106 and the third integrated circuit 108, integrated circuits which are separated and independent from each other, may be combined, or the integrated circuits may be formed to be integrated as long as their functions are independent. In light of the manufacturing yield, it is preferable that a plurality of integrated circuits, each of which area per integrated circuit is small, are combined.

Figure 3:
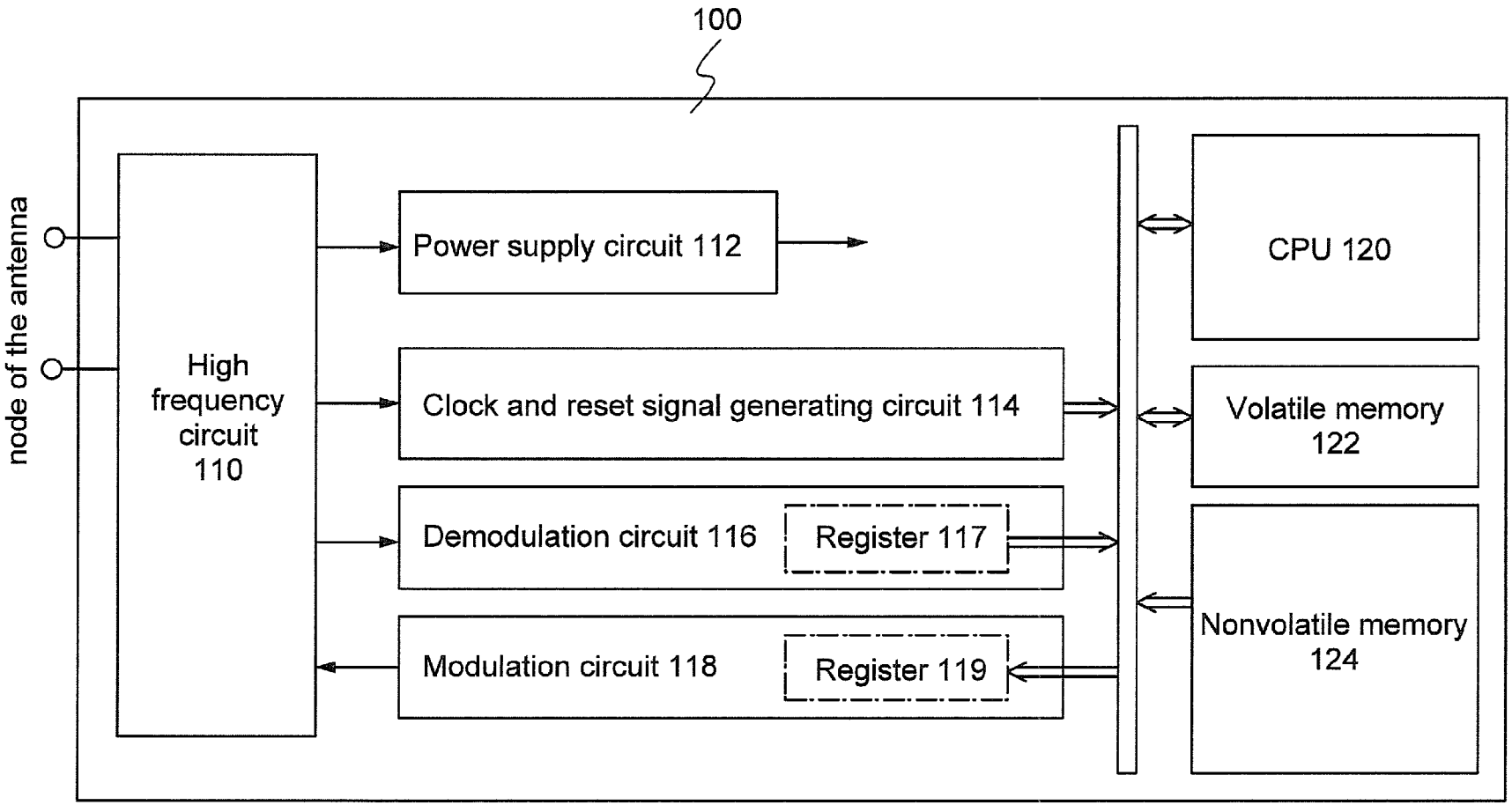
FIG. 3 shows a structure of a semiconductor device in accordance with Embodiment Mode 1.

The first integrated circuit 104, the second integrated circuit 106 and the third integrated circuit 108 each have a function of a wireless IC, since they are connected to the antenna 102. For example, the first integrated circuit 104, the second integrated circuit 106 and the third integrated circuit 108 have a structure as shown in FIG. 3. In FIG. 3, the integrated circuits each include a high frequency circuit 110 (RF circuit) connected to the antenna, a power supply circuit 112, a clock and reset signal generating circuit 114, a demodulation circuit 116, a modulation circuit 118, a logic circuit such as a CPU 120 (Central Processing Unit), a volatile memory 122 (typically, SRAM) as a work region, a writable nonvolatile memory 124 (typically, EEPROM) which stores a program of the CPU. With a semiconductor device having such a structure, a wireless IC which can be used at the same time for a plurality of applications can be formed by using different programs.

Programs are written after the integrated circuits are formed, thereby producing chips having the same circuit configuration irrespective of the applications, and low cost can be achieved. In other words, it is suitable for a limited production of diversified products.

For example, a wireless IC which is applicable for plural encryptions can be formed. For example, a wireless IC can be obtained, in which a nonvolatile memory of the first integrated circuit 104 stores a program regarding unencrypted communication, a nonvolatile memory of the second integrated circuit 106 stores a program regarding communication using an encryption system A, and a nonvolatile memory of the third integrated circuit 108 stores a program regarding communication using an encryption system B.

By using a structure like this, the first integrated circuit 104 decodes an instruction of the normal unencrypted communication, and responds thereto. On the other hand, the second integrated circuit 106 decodes an instruction of the communication using the encryption system A, and responds thereto. Further, the third integrated circuit 108 decodes an instruction of the communication using the encryption system B, and responds thereto. Note that even if each integrated circuit receives an instruction which is not supported by the integrated circuit, each integrated circuit does not respond to it. Thus, a collision of communication between these integrated circuits does not occur.

In addition, a wireless IC can respond to a plurality of communication systems. For example, as shown in FIG. 3, a register 117 and a register 119 which are each controlled by the CPU 120 are provided in the demodulation circuit 116 and the modulation circuit 118, respectively. Processing for converting a demodulation signal to data and encoding processing of data are controlled by the CPU 120. Additionally, the semiconductor device can be obtained, in which the nonvolatile memory of the first integrated circuit 104 stores a program regarding communication which employs a position modulation as a receiving system of a chip, and a standard using Manchester encoding (e.g. ISO15693) as a response system, and the nonvolatile memory of the second integrated circuit 106 stores a program regarding communication using another specific communication system.

A wireless IC like this is effective for a case where an antenna is formed over the same substrate as an integrated circuit. This is because the antenna size is larger than a chip in order to secure communication performance in many cases. Further, the chip has preferably flexibility. This is because the chip size becomes large since a plurality of integrated circuits are formed. In this case, there is an advantageous effect that the chip is hard to break, as compared with a single crystalline silicon substrate or a glass substrate.

Embodiment Mode 2

Embodiment Mode 2 will describe one mode of a semiconductor device including an antenna and a plurality of integrated circuits with reference to drawings.

Figure 4A:
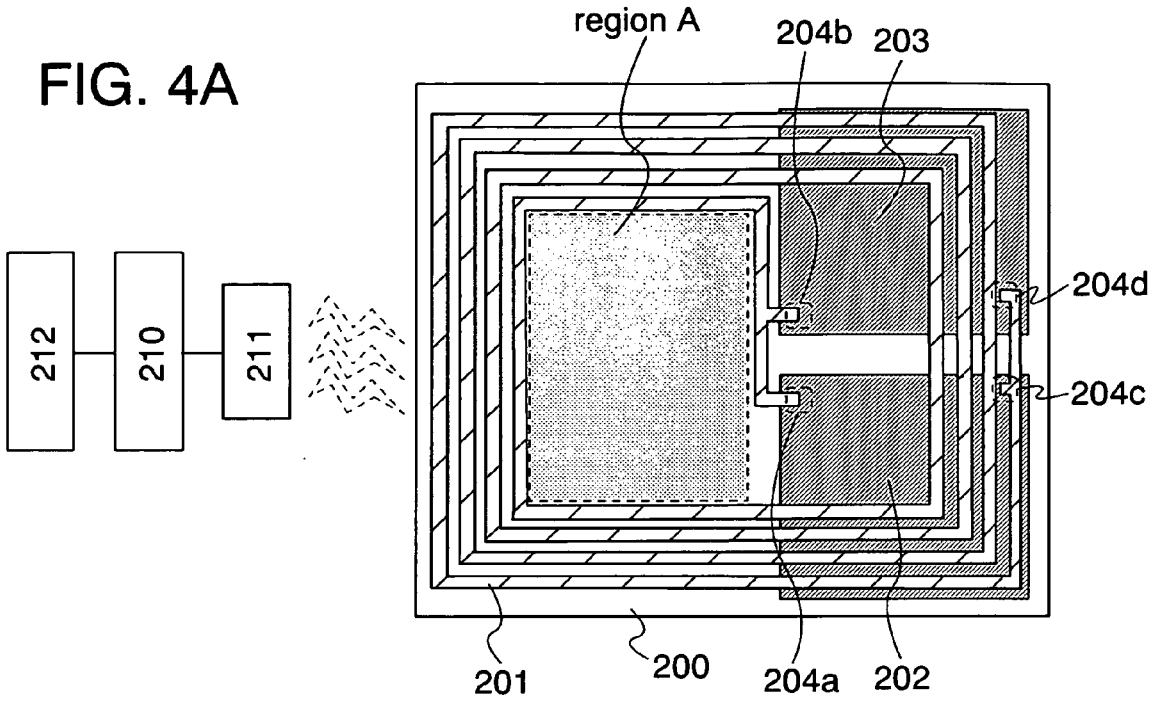
FIGS. 4A and 4B each show a structure of a semiconductor device in accordance with Embodiment Mode 2.

FIG. 4A shows a semiconductor device 200 in accordance with this embodiment mode. In the semiconductor device 200, a plurality of integrated circuits are connected to an antenna 201. In FIG. 4A, a first integrated circuit 202 and a second integrated circuit 203 as the plurality of integrated circuits are connected to the antenna 201 through connection portions 204*a* to 204*d*. Here, note that the same identification code is memorized in the first integrated circuit 202 and the second integrated circuit 203. In other words, the identification code of the first integrated circuit 202 and the second integrated circuit 203 become an identification code of the semiconductor device 200.

A wireless signal is output from an antenna 211 which is connected to a reader/writer 210. The wireless signal is an electromagnetic wave which is modulated in response to a transmitted instruction. An electromagnetic wave for transmitting an instruction is referred to as a carrier wave, and also, the wireless signal is referred to as a carrier wave modulated in response to the instruction. The wireless signal (carrier wave modulated in response to the instruction) is received by the antenna 201 included in the semiconductor device 200. The instruction of the received wireless signal is processed by the first integrated circuit 202 and the second integrated circuit 203. The first integrated circuit 202 and the second integrated circuit 203 output the memorized identification code in response to the processed instruction. Then, the carrier wave modulated in response to the identification code is transmitted to the antenna 211 of the reader/writer 210 from the antenna 201 of the semiconductor device 200. In this way, the carrier wave modulated in response to the identification code is received by the antenna 211. An identification code specific to the semiconductor device 200 of the present invention is recognized by the reader/writer 210 to which the antenna 211 is connected, and stored in a control terminal 212.

In a case where one integrated circuit is used in the semiconductor device 200, an error occurs, such that the specific identification code is not recognized because of a failure or a breakdown. However, as shown in this embodiment mode, a plurality of integrated circuits which memorize the same identification code are provided in the semiconductor device 200. Therefore, even when one integrated circuit has an error or is broken down for some reasons, an identification code specific to the semiconductor device can be recognized as long as another integrated circuit is operated normally.

This embodiment mode has shown that the semiconductor device 200 includes the first integrated circuit 202 and the second integrated circuit 203 which memorize the same identification code; however, the present invention is not limited thereto. A plurality of integrated circuits may be provided. By increasing the number of integrated circuits to be mounted, redundancy can be provided when an integrated circuit has an error or is broken down; therefore, a more excellent endurance can be obtained.

In addition, in FIG. 4A, the antenna 201 of the semiconductor device 200 overlaps with the first integrated circuit 202 and the second integrated circuit 203; however, this embodiment mode is not limited thereto. The antenna does not necessarily overlap with the integrated circuits. Note that in the case of a structure in which the antenna does not overlap with the integrated circuits, the connection portions 204*a* to 204*d* between the antenna 201 and the first integrated circuit 202 and the second integrated circuit 203, are not included in the structure. In the case that the antenna 201 overlaps with the first integrated circuit 202 and the second integrated circuit 203, a region A of the semiconductor device 200 (an appropriate region surrounded by a dotted line in FIGS. 4A and 4B) where they are not overlapped, becomes large. In the semiconductor device 200, when the region A is large, an alternating current magnetic field which is produced by the antenna 211 connected to the reader/writer 210 is easily transmitted, and thus, an electromotive force is easily produced. Even when the distance between the semiconductor device 200 and the antenna 211 of the reader/writer 210 is long, the semiconductor device is easily influenced by the alternating current magnetic field which is produced by the antenna 211. Thus, the semiconductor device is suitable for identification in the long distance.

Figure 4B:
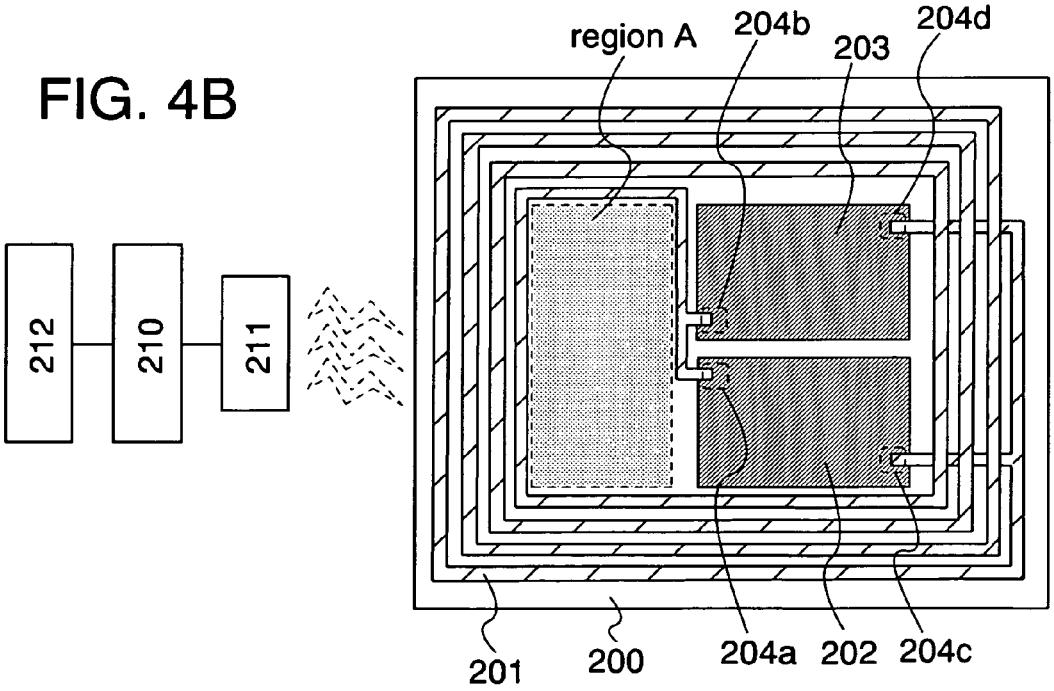

On the other hand, as shown in FIG. 4B, in the case that the antenna 201 included in the semiconductor device 200 does not overlap with the first integrated circuit 202 and the second integrated circuit 203, except for the connection portions 204*a* to 204*d*, the area (region A) of the semiconductor device 200 other than the antenna 201, the first integrated circuit 202 and the second integrated circuit 203 becomes small. In the semiconductor device 200, when the region A is small, it is difficult to transmit an alternating current magnetic field which is produced by the antenna 211 connected to the reader/writer 210. In other words, the distance between the semiconductor device 200 and the antenna 211 of the reader/writer 210 is small, the semiconductor device 200 is easily recognized. Thus, it is easy to prevent information from being leaked to others and thus, it is suitable for recognition of secret information such as the individual authentication or identification of personal information, leakage of which may cause a problem.

Embodiment Mode 3

Embodiment Mode 3 will describe one mode of a semiconductor device including an antenna and a plurality of integrated circuits with reference to drawings.

Figure 5A:
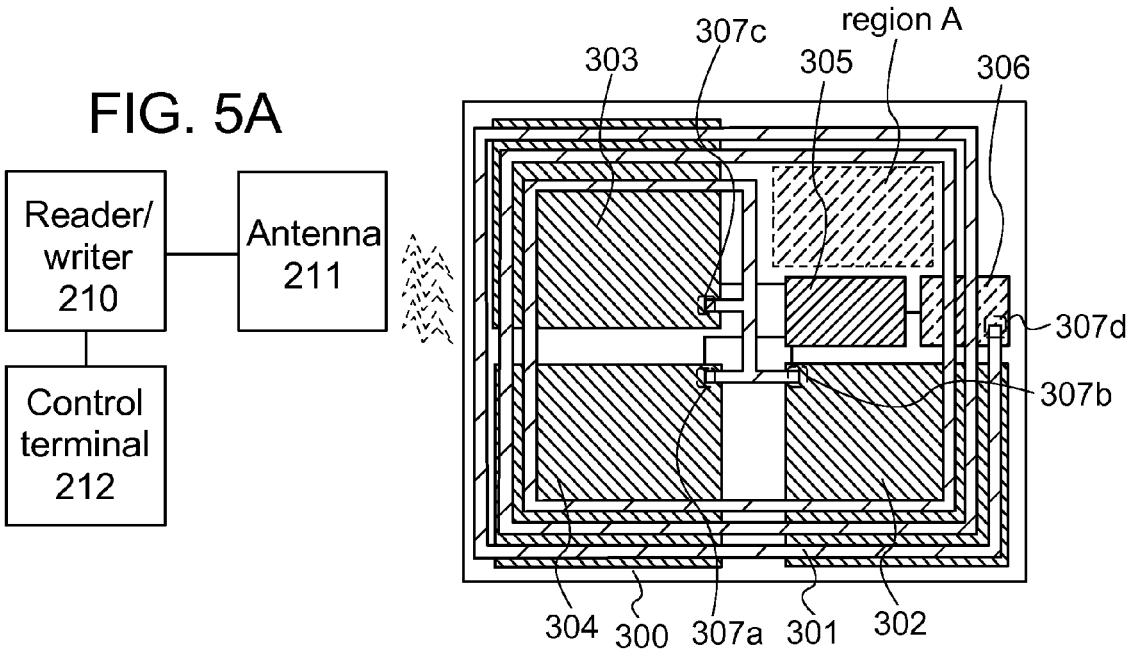
FIGS. 5A to 5C each show a structure of a semiconductor device in accordance with Embodiment Mode 3.

A semiconductor device of this embodiment mode includes a plurality of integrated circuits and a majority circuit for one antenna. In FIG. 5A, as a semiconductor device 300, an antenna 301 is connected to a first integrated circuit 302, a second integrated circuit 303 and a third integrated circuit 304 through connection portions 307*a* to 307*c*. The antenna 301 is connected to a modulation circuit 306 through a connection portion 307*d*, and further, a majority circuit 305 is connected to the first integrated circuit 302, the second integrated circuit 303 and the third integrated circuit 304 through a connection line shown in FIG. 5A. These connections shown in FIG. 5A are just examples. Here, the first integrated circuit 302, the second integrated circuit 303 and the third integrated circuit 304 memorize the same identification code. In other words, the identification code of the first integrated circuit 302, the second integrated circuit 303 and the third integrated circuit 304 become an identification code specific to the semiconductor device 300.

A wireless signal is output from the antenna 211 connected to the reader/writer 210. The wireless signal is an electromagnetic wave which is modulated in response to a transmitted instruction. An electromagnetic wave for transmitting an instruction is referred to as a carrier wave, and also, the wireless signal is referred to as a carrier wave modulated in response to the instruction. The wireless signal (carrier wave modulated in response to the instruction) is received by the antenna 301. The instruction of the received wireless signal is processed by the first integrated circuit 302, the second integrated circuit 303 and the third integrated circuit 304. The first integrated circuit 302, the second integrated circuit 303 and the third integrated circuit 304 output the memorized identification code in response to the processed instruction. The output identification code passes through the majority circuit 305 and then, is transmitted to the modulation circuit 306.

Figure 5B:
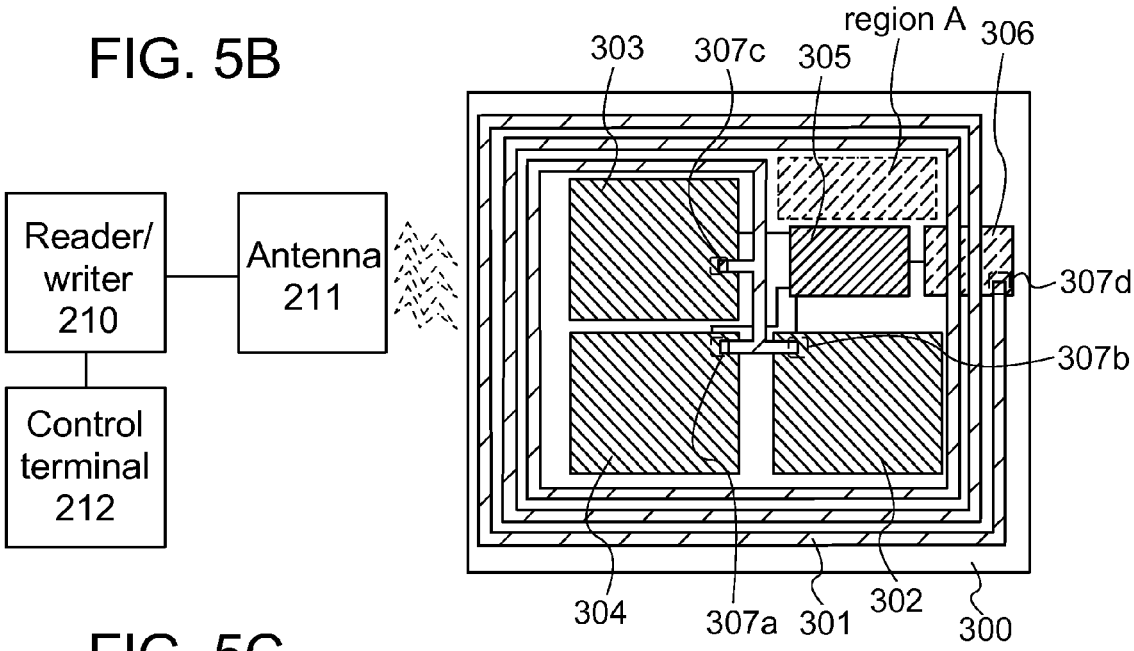
Figure 5C:
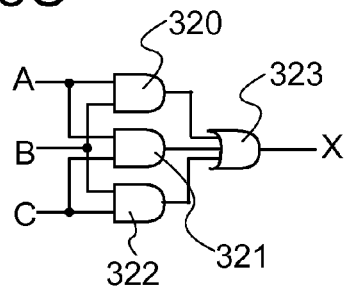

FIG. 5C shows a circuit diagram of the majority circuit 305 and Table 1 shows a truth table. In this embodiment mode, since there are three outputs, a three-variable majority circuit is obtained. The majority circuit includes three AND circuits, i.e., a first AND circuit 320, a second AND circuit 321, a third AND circuit 322 and one OR circuit 323.

TABLE 1

| A | B | C | X |
|---|---|---|---|
| 0 | 0 | 0 | 0 |
| 0 | 0 | 1 | 0 |
| 0 | 1 | 0 | 0 |
| 0 | 1 | 1 | 1 |
| 1 | 0 | 0 | 0 |
| 1 | 0 | 1 | 1 |
| 1 | 1 | 0 | 1 |
| 1 | 1 | 1 | 1 |

Note that the majority circuit 305 is a logic circuit, as shown in FIG. 5C, which includes input terminals (A to C) for a plurality of signals (here, identification codes), and an output terminal (X) for outputting signals (here, identification codes) whose input number is larger by a majority, among the plurality of input signals. The majority circuit 305 is not limited to the circuit configuration shown in FIG. 5C, and any circuit configuration may be used as long as it has the same function.

An identification code sent to the modulation circuit 306 is converted to a carrier wave which is modulated in response to the identification code. The carrier wave modulated in response to the identification code is transmitted to the antenna 211 which is connected to the reader/writer 210, from the antenna 301. In this way, the carrier wave modulated in response to the identification code is received by the antenna 211. An identification code specific to the semiconductor device 300 is recognized by the reader/writer 210 which is connected to the antenna 211, and stored in the control terminal 212.

In this embodiment mode, even if one of the three integrated circuits memorizing the same identification codes, i.e., the first integrated circuit 302, the second integrated circuit 303 and the third integrated circuit 304 has a defective operation by some reasons and outputs a different identification code, the different identification code can be excluded, and thus, redundancy can be provided for the semiconductor device, when an integrated circuit conducts a defective operation.

In addition, in FIG. 5A, the antenna 301 of the semiconductor device 300 overlaps with the first integrated circuit 302, the second integrated circuit 303 and the third integrated circuit 304; however, this embodiment mode is not limited thereto. The antenna does not necessarily overlap with the integrated circuits. Note that in the case of a structure in which the antenna does not overlap with the integrated circuits, the connection portions 307*a* to 307*d* between the antenna 301 and the first integrated circuit 302, the second integrated circuit 303 and the third integrated circuit 304, are not included in the structure. In the case that the antenna 301 overlaps with the first integrated circuit 302, the second integrated circuit 303 and the third integrated circuit 304, a region A of the semiconductor device 300 (an appropriate region surrounded by a dotted line in FIGS. 5A and 5B) where they are not overlapped, becomes large. In the semiconductor device 300, when the region A is large, an alternating current magnetic field which is produced by the antenna 211 connected to the reader/writer 210 is easily transmitted, and thus, an electromotive force is easily produced. Even when the distance between the semiconductor device 200 and the antenna 211 of the reader/writer 210 is long, the semiconductor device is easily influenced by the alternating current magnetic field which is produced by the antenna 211. Thus, the semiconductor device is suitable for identification in the long distance.

On the other hand, as shown in FIG. 5B, in the case that the antenna 301 included in the semiconductor device 300 does not overlap with the first integrated circuit 302, the second integrated circuit 303 and the third integrated circuit 304, except for the connection portions 307*a* to 307*d*, the area (region A) of the semiconductor device 300 other than the antenna 301, the first integrated circuit 302, the second integrated circuit 303, the third integrated circuit 304, the majority circuit 305 and the modulation circuit 306 becomes small. In the semiconductor device 300, when the region A is small, it is difficult to conduct an alternating current magnetic field which is produced by the antenna 211 connected to the reader/writer 210. In other words, the distance between the semiconductor device 300 and the antenna 211 of the reader/writer 210 is short, the semiconductor device 300 is easily recognized. Thus, it is easy to prevent information from being leaked to others and thus, it is suitable for identification of secret information such as the individual authentication or identification of personal information, leakage of which may cause a problem.

This embodiment mode has shown the case that the semiconductor device includes three integrated circuit which memorize the same identification code and a majority circuit; however, three or more integrated circuits may be used. In that case, a plurality of majority circuits for input are used. When a semiconductor device includes a plurality of, i.e., three or more semiconductor integrated circuits which memorize the same identification code and a majority circuit, higher redundancy can be provided when a semiconductor integrated circuit has an error or is broken down.

Embodiment Mode 4

Embodiment Mode 4 will describe a structure of an antenna and an integrated circuit with reference to drawings.

Figure 6:
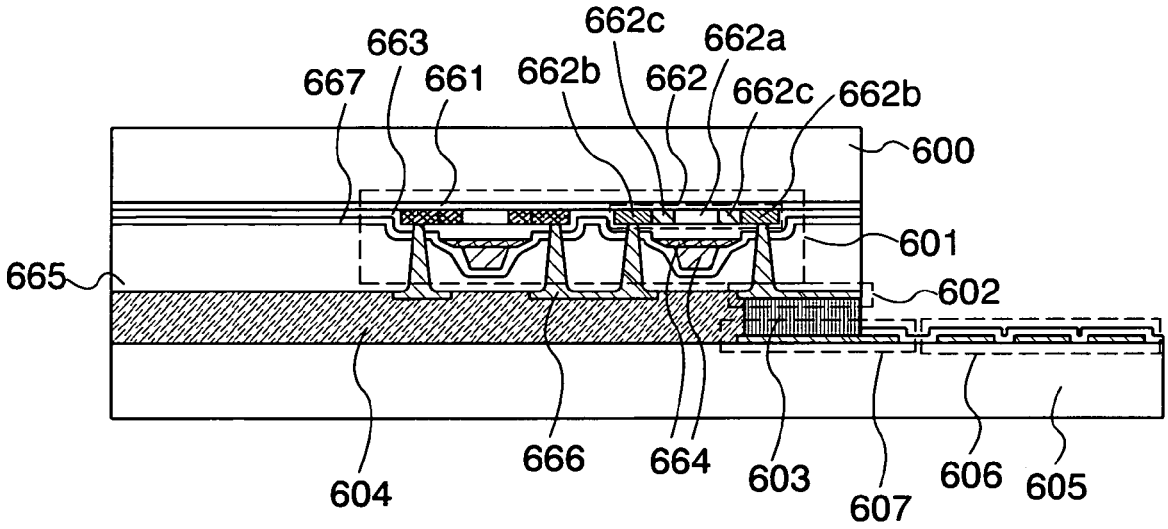
FIG. 6 shows a structure of a semiconductor device in accordance with Embodiment Mode 4.

FIG. 6 shows an antenna, an integrated circuit, and a connection portion of the antenna and the integrated circuit. An element group 601 including a transistor is formed over a substrate 600. The element group 601 includes a plurality of transistors and a circuit is formed with a wire 666. Further, a terminal portion 602 which is electrically connected to the element group 601 is formed over the substrate 600. The terminal portion 602 is connected to an antenna 606 which is formed over another substrate 605, which is different from the substrate 600. A terminal portion 607 which is electrically connected to the antenna 606 is formed over the substrate 605. The terminal portion 607 is electrically connected to the terminal portion 602 through a conductive particle 603. A connection portion which is electrically connected to the antenna 606 and the element group 601 (also referred to as the integrated circuit) includes the terminal portion 602 and the terminal portion 607. Alternatively, the connection portion includes the terminal portion 602, the terminal portion 607, and the conductive particle 603.

In the structure shown in FIG. 6, a part of the wire for connecting a transistor of the element group 601 is used as the terminal portion 602. The substrate 600 is attached to the substrate 605 provided with the antenna 606, in such a way that the terminal portion 607 of the antenna 606 is connected to the terminal portion 602. A conductive particle 603 and a resin 604 are provided between the substrate 600 and the substrate 605. By the conductive particle 603, the terminal portion 607 of the antenna 606 is electrically connected to the terminal portion 602.

A structure and a manufacturing method of the element group 601 are described. Formed over a large substrate in a plural numbers and divided later to be completed by cutting the large substrate, the element groups 601 can be inexpensively provided. As the substrate 600, for example, a glass substrate such as barium borosilicate glass and alumino borosilicate glass, a quartz substrate, a ceramic substrate, or the like can be used. Moreover, a semiconductor substrate over which an insulating film is formed may be used as well. A substrate formed of a synthetic resin having flexibility such as plastic may also be used. The surface of a substrate may be planarized by being polished by a CMP method or the like. Moreover, a substrate which is formed to be thin by polishing a glass substrate, a quartz substrate, or a semiconductor substrate may be used as well.

As a base layer 661 provided over the substrate 600, an insulating film such as silicon oxide, silicon nitride, or silicon nitride oxide can be used. The base layer 661 can prevent an alkali metal such as Na or an alkaline earth metal contained in the substrate 600 from dispersing into the semiconductor layer 662 and adversely affecting the characteristics of the transistor. In FIG. 6, the base layer 661 is formed with from a single layer; however, it may be formed with two or more layers. It is to be noted that the base layer 661 is not always required to be provided when the dispersion of impurities is not a big problem, such as the case of using a quartz substrate.

It is to be noted that high density plasma may be directly applied to the surface of the substrate 600. The high density plasma is generated in 2.45 GHz, for example, by a microwave. It is to be noted that high density plasma with an electron density of $10^{11}$ to $10^{13}/cm^3$, an electron temperature of 2 eV or lower, and an ion energy of 5 eV or lower is used. In this manner, high density plasma which features low electron temperature has low kinetic energy of active species; therefore, a film with fewer plasma damage and defects can be formed as compared to conventional plasma treatment. Plasma can be generated by using a plasma processing apparatus utilizing a microwave excitation, which employs a radial slot antenna. The antenna which generates a microwave and the substrate 600 are placed at a distance of 20 to 80 mm (preferably 20 to 60 mm). By performing the high density plasma treatment in an atmosphere containing nitrogen, for example, an atmosphere containing nitrogen (N) and a rare gas (at least one of He, Ne, Ar, Kr, and Xe), an atmosphere containing nitrogen, hydrogen (H), and a rare gas, or an atmosphere containing ammonium ($NH_3$) and a rare gas, the surface of the substrate 600 can be nitrided. In the case where glass, quartz, a silicon wafer, or the like is used as the substrate 600, a nitride layer formed over the surface of the substrate 600 contains silicon nitride as a main component, and it can be used as a blocking layer against impurities which are dispersed from the substrate 600 side. A silicon oxide film or a silicon oxynitride film may be formed over the nitride layer by a plasma CVD method to be used as the base layer 661.

By applying a similar high density plasma treatment to the surface of the base layer 661 formed of silicon oxide or silicon oxynitride, the surface and a depth of 1 to 10 nm from the surface can be nitrided. This extremely thin silicon nitride layer is preferable since it functions as a blocking layer and has less stress on the semiconductor layer 662 formed thereover.

A single crystalline semiconductor layer or a polycrystalline semiconductor layer can be used as the semiconductor layer 662. A polycrystalline semiconductor layer can be obtained by crystallizing an amorphous semiconductor film. A laser crystallization method, a thermal crystallization method using RTA or an annealing furnace, a thermal crystallization method using a metal element which promotes crystallization, or the like can be used as the crystallization method. The semiconductor layer 662 includes a channel forming region 662*a* and a pair of impurity regions 662*b* to which an impurity element which imparts a conductivity is added. Shown here is a structure where a low concentration impurity region 662*c* to which the impurity element is added at a lower concentration than to the impurity regions 662*b* is provided between the channel forming region 662*a* and the pair of impurity regions 662*b*; however, the present invention is not limited to this. The low concentration impurity region 662*c* is not necessarily provided. In the channel forming region 662*a* of the transistor, an impurity element which imparts a conductivity may be added. In this way, a threshold voltage of the transistor can be controlled.

A single layer or a stack of a plurality of layers formed of silicon oxide, silicon nitride, silicon nitride oxide or the like can be used as a first insulating film 663. In this case, high density plasma is applied to the surface of the first insulating film 663 in an oxidized atmosphere or a nitrided atmosphere; thereby the first insulating film 663 may be oxidized or nitrided to be densified. The high density plasma is generated in 2.45 GHz, for example, by a microwave, as described above. It is to be noted that high density plasma with an electron density of $10^{11}$ to $10^{13}/cm^3$ or higher and an electron temperature of 2 eV or lower, and an ion energy of 5 eV or lower is used. Plasma can be generated by using a plasma processing apparatus utilizing a microwave excitation, which employs a radial slot antenna.

Before forming the first insulating film 663, the surface of the semiconductor layer 662 may be oxidized or nitrided by applying the high density plasma treatment to the surfaces of the semiconductor layer 662. At this time, by performing the treatment in an oxidized atmosphere or a nitrided atmosphere with the substrate 600 at a temperature of 300 to 450° C., a favorable interface with the first insulating film 663 which is formed thereover, can be formed. As the nitrided atmosphere, an atmosphere containing nitrogen (N) and a rare gas (at least one of He, Ne, Ar, Kr, and Xe), an atmosphere containing nitrogen, hydrogen (H), and a rare gas, or an atmosphere containing ammonium ($NH_3$) and a rare gas can be used. As the oxidized atmosphere, an atmosphere containing oxygen (O) and a rare gas, an atmosphere containing oxygen and hydrogen (H), and a rare gas or an atmosphere containing dinitrogen monoxide ($N_2O$) and a rare gas can be used.

As the gate electrode 664, an element selected from Ta, W, Ti, Mo, Al, Cu, Cr, and Nd, an alloy or a compound containing a plurality of the aforementioned elements can be used. In addition, a single layer structure or a stacked-layer structure can be employed.

A transistor is formed of the semiconductor layer 662, the gate electrode 664, and a first insulating film 663 which functions as a gate insulating film between the semiconductor layer 662 and the gate electrode 664. In FIG. 6, the transistor has a top gate structure; however, it may be a bottom gate transistor having a gate electrode under the semiconductor layer, or a dual gate transistor having gate electrodes over and under the semiconductor layer.

It is preferable that a second insulating film 667 is an insulating film such as a silicon nitride film having a barrier property to block ion impurities. The second insulating film 667 is formed of silicon nitride or silicon oxynitride. The second insulating film 667 functions as a protective film which prevents contamination of the semiconductor layer 662. By introducing a hydrogen gas and applying the aforementioned high density plasma treatment after depositing the second insulating film 667, the second insulating film 667 may be hydrogenated. Alternatively, the second insulating film 667 may be nitrided and hydrogenated by introducing an ammonium gas ($NH_3$). Otherwise, an oxidization-nitridation treatment and a hydrogenation treatment may be performed by introducing oxygen, a dinitrogen monoxide ($N_2O$) gas, or the like together with a hydrogen gas. By performing a nitridation treatment, an oxidization treatment, or an oxidization-nitridation treatment by this method, the surface of the second insulating film 667 can be densified. In this manner, a function of the second insulating film 667 as a protective film can be enhanced. Hydrogen introduced in the second insulating film 667 is discharged by a thermal treatment at 400 to 450° C., thereby the semiconductor layer 662 can be hydrogenated. It is to be noted that the hydrogenation treatment may be performed in combination with a hydrogenation treatment using hydrogen introduced in the first insulating film 663.

A third insulating film 665 can be formed of a single layer structure or a stacked-layer structure of an inorganic insulating film or an organic insulating film. As an inorganic insulating film, a silicon oxide film formed by a CVD method, a silicon oxide film formed by a SOG (Spin On Glass) method, or the like can be used. As an organic insulating film, a film formed of polyimide, polyamide, BCB (benzocyclobutene), acrylic, a positive photosensitive organic resin, a negative photosensitive organic resin, or the like can be used. The third insulating film 665 may be formed of a material having a skeleton structure formed of a bond of silicon (Si) and oxygen (O). An organic group containing at least hydrogen (such as an alkyl group or aromatic hydrocarbon) is used as a substituent of this material. Also, a fluoro group may be used as the substituent. Further, a fluoro group and an organic group containing at least hydrogen may be used as the substituent.

As the wire 666, one element selected from Al, Ni, W, Mo, Ti, Pt, Cu, Ta, Au, or Mn or an alloy containing a plurality of these elements can be used. In addition, a single layer structure or a stacked-layer structure can be used. The wire 666 serves as a wire to be connected to a source or a drain of the transistor, and at the same time, becomes the terminal portion 602.

The antenna 606 can be formed using a conductive paste containing nano-particles of Au, Ag, Cu or the like by a printing technique such as an inkjet method or a screen printing method. In addition, a pattern can be formed by discharging droplets, such as a dispenser method, which has advantages in that utilization efficiency of a material is improved, and the like.

Figure 7A:
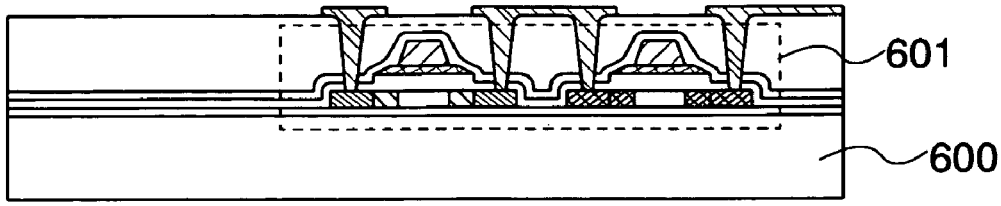
FIGS. 7A to 7D each show a structure of a semiconductor device in accordance with Embodiment Mode 4.
Figure 7B:
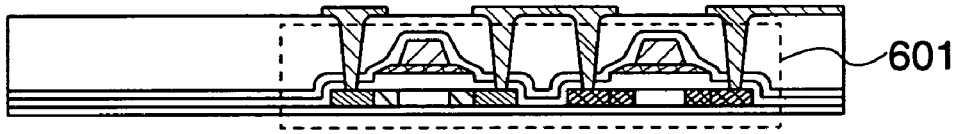
Figure 7C:
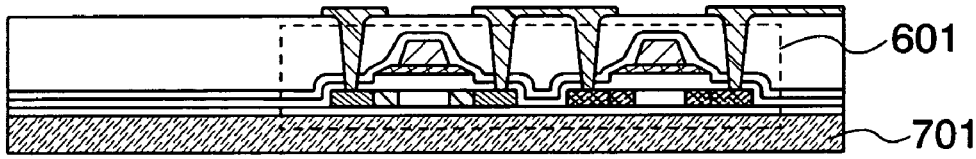

The element group 601 formed over the substrate 600 (see FIG. 7A) may be used as it is; however, the element group 601 may be peeled off the substrate 600 (see FIG. 7B) and attached to a flexible substrate 701 (see FIG. 7C). The flexible substrate 701 has flexibility, and as the substrate 701, a plastic substrate, formed of polycarbonate, polyarylate, polyether sulfone, or the like, a ceramic substrate, or the like can be used.

The element group 601 can be peeled off the substrate 600 by (A) providing a peeling layer between the substrate 600 and the element group 601 in advance and removing the peeling layer by using an etching agent, (B) partially removing the peeling layer by using an etching agent and physically peeling the element group 601 from the substrate 600, or (C) mechanically removing the substrate 600 having high heat resistance over which the element group 601 is formed or removing it by etching with a solution or a gas. It is to be noted that "being physically peeled off" corresponds to being peeled off by external stress, for example, stress applied by wind pressure of a gas blown from a nozzle, ultrasonic wave, or the like.

As a more specific method of the aforementioned methods (A) or (B), there is given a method of providing a metal oxide film between the substrate 600 having high heat resistance and the element group 601 and weakening the metal oxide film by crystallization to peel off the element group 601, or a method of providing an amorphous silicon film containing hydrogen between the substrate 600 having high heat resistance and the element group 601 and removing the amorphous silicon film by laser irradiation or etching to peel off the element group 601. The element group 601 which has been peeled off may be attached to the flexible substrate 701 by using a commercialized adhesive, for example, an epoxy resin-based adhesive or a resin additive.

Figure 7D:
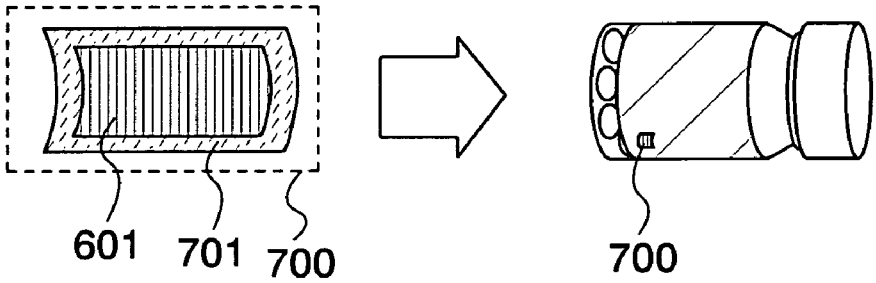

When the element group 601 is attached to the flexible substrate 701 over which an antenna is formed so that the element group 601 and the antenna are electrically connected, a semiconductor device which is thin, lightweight, and can withstand shock when dropped, is completed (see FIG. 7C). When the inexpensive flexible substrate 701 is used, an inexpensive semiconductor device can be provided. Moreover, as the flexible substrate 701 has flexibility, it can be attached to a curved surface or an irregular surface, a variety of applications can be realized. For example, an integrated circuit as one mode of the semiconductor device of the present invention can be tightly attached to, for example, a surface such as one of a medicine bottle (see FIG. 7D). Moreover, by reusing the substrate 600, a semiconductor device can be manufactured at low cost.

The element group 601 can be sealed by being covered with a film. The surface of the film may be coated with silicon dioxide (silica) powder. The coating allows the element group 601 to be kept waterproof in an environment of high temperature and high humidity. In other words, the element group 601 can have moisture resistance. Moreover, the surface of the film may have antistatic properties. The surface of the film may also be coated with a material containing carbon as its main component (e.g., diamond like carbon). The coating increases the intensity and can suppress the degradation or destruction of a semiconductor device. In addition, the film may be formed of a material in which a base material (for example, resin) is mixed with silicon dioxide, a conductive material, or a material containing carbon as its main component. In addition, a surface active agent may be applied to the surface of the film to coat the surface, or directly mixed into the film, so that the element group 601 can have antistatic properties.

Embodiment Mode 5

Embodiment Mode 5 will describe a structure of a semiconductor device in which a thin wafer provided with an integrated circuit is combined with a flexible substrate with reference to drawings.

Figure 8A:
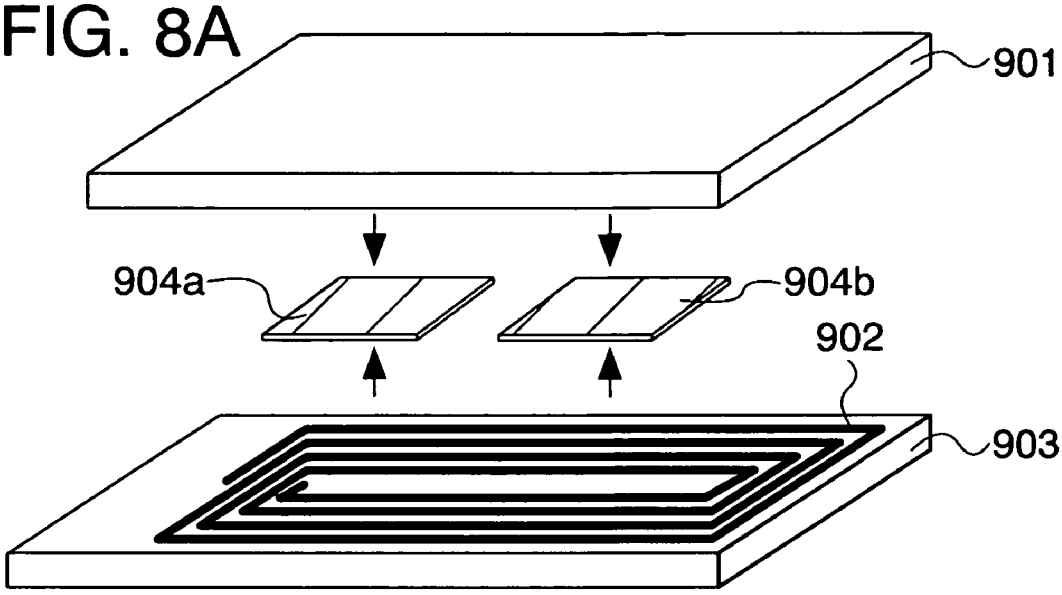
FIGS. 8A to 8C each show a structure of a semiconductor device in accordance with Embodiment Mode 5.

In FIG. 8A, a semiconductor device of the present invention includes a flexible protective layer 901, a flexible protective layer 903 including an antenna 902, and an element group 904 formed by a peeling process or thinning of a substrate. The element group 904 can have a similar structure to that of the element group 601 described in Embodiment Mode 3. The antenna 902 formed over the protective layer 903 is electrically connected to the element group 904. In FIG. 8A, the antenna 902 is formed only over the protective layer 903; however, the present invention is not limited to this structure and the antenna 902 may be formed over the protective layer 901 as well. A barrier film formed of a silicon nitride film or the like is preferably formed between the element group 904 and the protective layer 901, and between the element group 904 and the protective layer 903. As a result, a semiconductor device with improved reliability can be provided without contaminating the element group 904.

The antenna 902 can be formed of Ag, Cu, or a metal plated with Ag or Cu. The element group 904 and the antenna 902 can be connected to each other by using an anisotropic conductive film and being subjected to an ultraviolet treatment or an ultrasonic wave treatment. It is to be noted that the element group 904 and the antenna 902 may be attached to each other by using a conductive paste. The semiconductor device is completed by sandwiching the element group 904 between the protective layer 901 and the protective layer 903 (see the arrow of FIG. 8A).

Figure 8B:
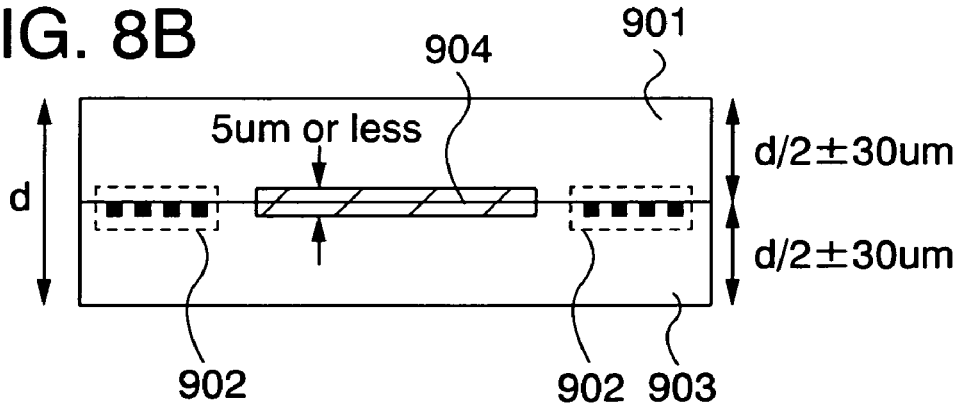

FIG. 8B shows a cross sectional structure of the semiconductor device formed in this manner. The element group 904 which is sandwiched has a thickness of 5 μm or thinner, or preferably 0.1 to 3 μm. Moreover, when the protective layer 901 and the protective layer 903 which are overlapped have a thickness of d, each of the protective layer 901 and the protective layer 903 preferably has a thickness of (d/2)±30 μm, and more preferably (d/2)±10 μm. Further, it is preferable that each of the protective layer 901 and the protective layer 903 have a thickness of 10 to 200 μm. Furthermore, the element group 904 has an area of 10 mm square (100 $mm^2$) or smaller and more preferably 0.3 to 4 mm square (0.09 to 16 $mm^2$).

The protective layer 901 and the protective layer 903 are formed of an organic resin material and thus, they have high resistance against bending. The element group 904 itself which is formed by a peeling process or thinning of a substrate also has higher resistance against bending as compared to a single crystalline semiconductor. Since the element group 904, the protective layer 901, and the protective layer 903 can be tightly attached to each other without any space therebetween, a completed semiconductor device itself has high resistance against bending. The element group 904 surrounded by the protective layer 901 and the protective layer 903 may be provided over a surface of or inside another object or embedded in paper.

Figure 8C:
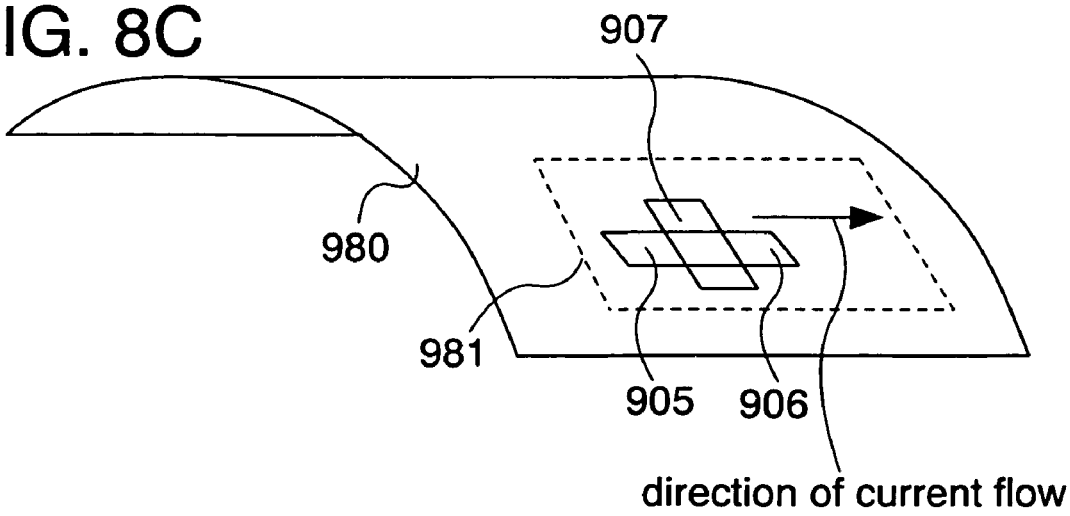

With reference to FIG. 8C, a case of attaching a semiconductor device including the element group 904 to a substrate having a curved surface will be described. In FIG. 8C, one transistor 981 selected from the element group 904 is shown. In the transistor 981, a current flows from one side 905 of a source and a drain to the other side 906 of the source and the drain in accordance with a potential of a gate electrode 907. The transistor 981 is provided such that the direction of current flow in the transistor 981 (carrier movement direction) and the direction of the arc of the substrate 980 cross at right angles. With such an arrangement, the transistor 981 is less affected by stress even when the substrate 980 is bent and the shape thereof becomes an arc, and thus variations in characteristics of the transistor 981 included in the element group 904 can be suppressed.

Embodiment Mode 6

In this embodiment mode, applications of a semiconductor device (also referred to as a wireless IC) of the present invention, which can send and receive information without contact, will be described with reference to FIGS. 9A, 9B and 10A to 10E. The wireless IC 700 can be applied to paper money, coins, securities, unregistered bonds, documents (a driver's license or a resident's card; see FIG. 10A), packaging containers (wrapping paper or a bottle; see FIG. 10B), recording media (see FIG. 10C) such as DVD software, a compact disc (CD), and a video tape. In addition, the wireless IC 700 can be applied to vehicles such as cars, motor bicycles and bicycles (see FIG. 10D), personal belongings such as bags and glasses (see FIG. 10E), groceries, clothes, daily commodities, and electronic devices. The electronic devices include liquid crystal display devices, EL (electroluminescence) display devices, television devices (also simply called televisions or television receivers), portable phones, and the like.

The wireless IC 700 can be attached to a surface of an object or embedded in an object to be fixed. For example, the wireless IC 700 is preferably embedded in a paper of a book or in an organic resin of a package which is formed of the organic resin. By providing the wireless IC 700 in paper money, coins, securities, unregistered bonds, documents, or the like, forgery thereof can be prevented. Moreover, by providing the wireless IC 700 in packaging containers, recording media, personal belongings, groceries, clothes, daily commodities, electronic devices, or the like, efficiency of the inspection system or the system of a rental shop can be facilitated. Moreover, by providing the wireless IC 700 in vehicles, forgery or theft thereof can be prevented. By implanting the wireless IC 700 in living things such as animals, each living thing can be easily identified. For example, by implanting a wireless tag in living things such as domestic animals, its year of birth, sex, breed, and the like can be easily recognized.

As described above, the wireless IC 700 of the present invention can be applied to any object (including living things), and is effective in an environment in which an object having the wireless IC 700 is easy to be broken down.

The wireless IC 700 has various advantages in that it can transmit and receive data through wireless communication, it can be processed into various shapes, it has a wide directivity and recognition range depending on the selected frequency, and the like.

Figure 9A:
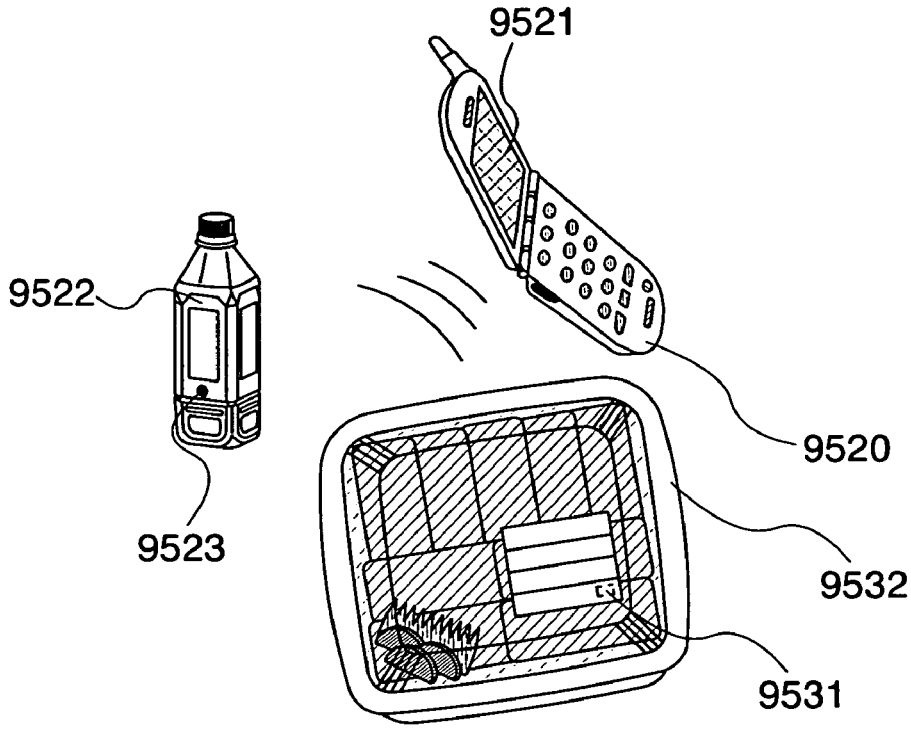
FIGS. 9A and 9B show an application example of a semiconductor device and a flow chart thereof in accordance with Embodiment Mode 6.
Figure 9B:
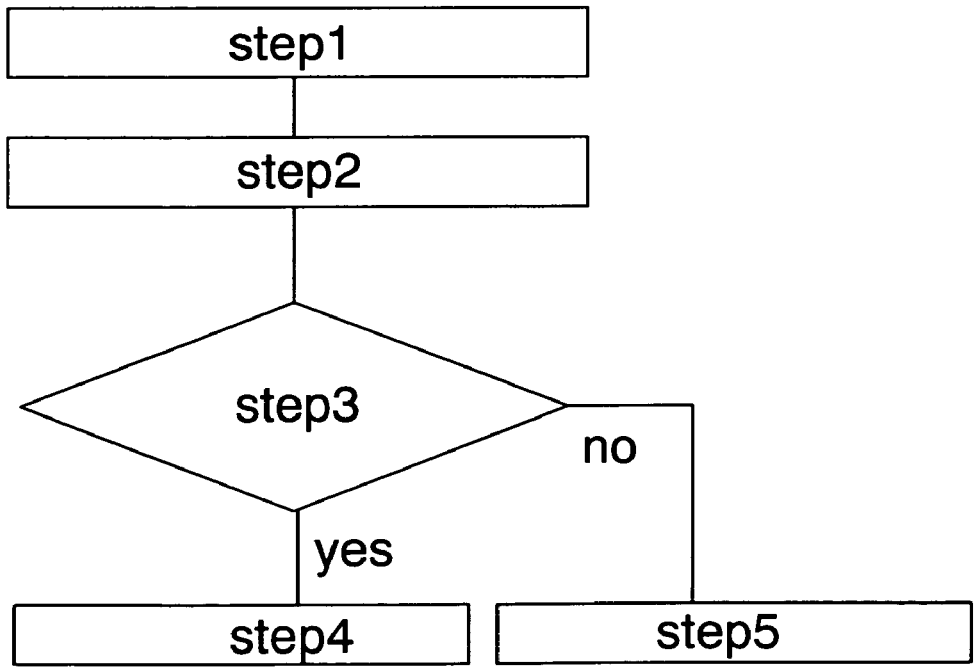
Figure 10A:
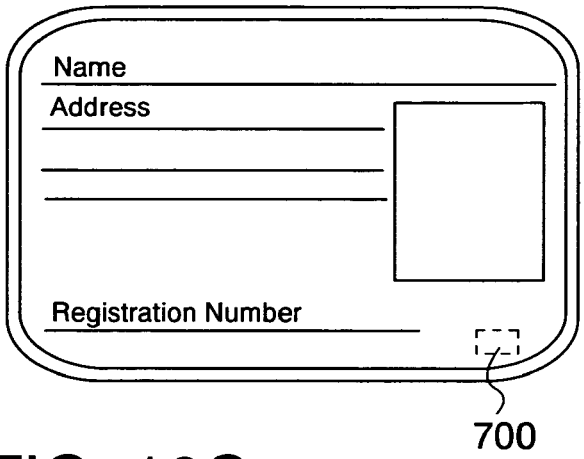
FIGS. 10A to 10E each show application example of a semiconductor device in accordance with Embodiment Mode 6.
Figure 10B:
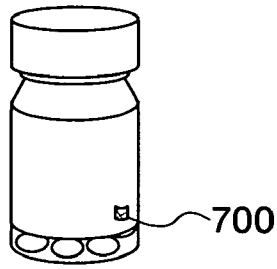
Figure 10C:
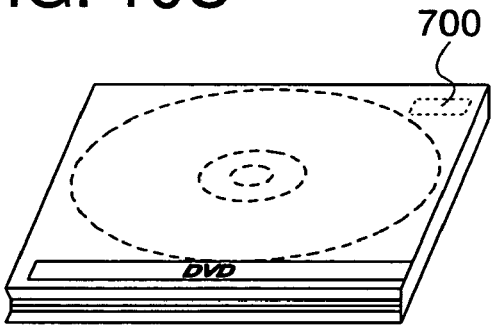
Figure 10D:
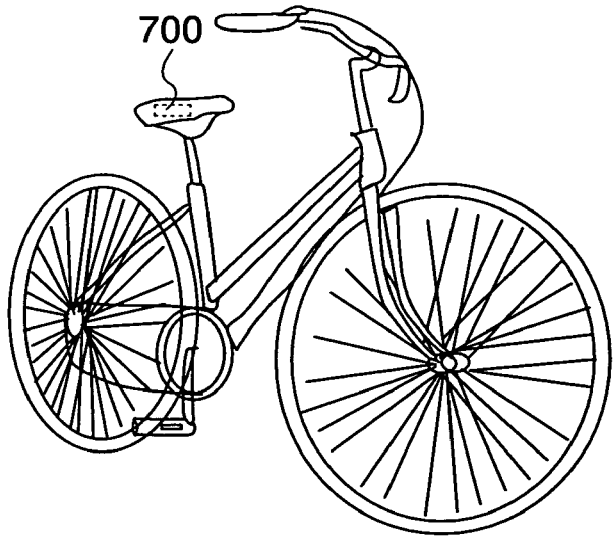
Figure 10E:
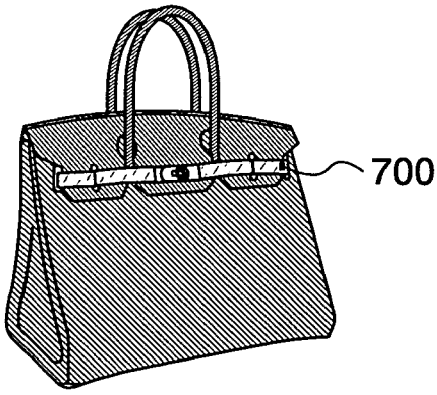

Next, one mode of a system utilizing the wireless IC 700 will be described with reference to FIGS. 9A and 9B. A reader/writer 9520 is provided on a side surface of a portable terminal including a display portion 9521. A semiconductor device 9523 (a wireless IC 700) is provided on a side surface of an object A 9522 and a semiconductor device 9531 of the present invention is provided on a top surface of an object B 9532 (see FIG. 9A). When the reader/writer 9520 is held near the semiconductor device 9523 of the object A 9522, the display portion 9521 displays information about the object A 9522, such as a raw material, a place of origin, a test result of every process, a record of circulation, and description of the object. When the reader/writer 9520 is held near the semiconductor device 9531 of the object B 9532, the display portion 9521 displays information about the object B 9532, such as a raw material, a place of origin, a test result of every process, a record of circulation, and description of the object.

An example of a business model utilizing the system shown in FIG. 9A will be described with reference to a flow chart shown in FIG. 9B. Information on allergy is input to a portable terminal (Step 1). The information on allergy is information on medical products, their components, or the like that may cause allergic reactions to certain people. As described above, information on the object A 9522 is obtained by the reader/writer 9520 incorporated in the portable terminal (Step 2). Here, the object A 9522 is a medical product. The information on the object A 9522 includes information on the components and the like of the object A 9522. The information on allergy is compared to the obtained information on components and the like of the object A 9522, thereby determining whether corresponding components are contained (Step 3). If the corresponding components are contained, the user of the portable terminal is alerted that certain people may have allergic reactions to the object A (Step 4). If the corresponding components are not contained, the user of the portable terminal is informed that certain people are at low risk of having allergic reactions to the object A (the fact that the object A is safe) (Step 5). In Steps 4 and 5, in order to inform the user of the portable terminal of the information, the information may be displayed on the display portion 9521 of the portable terminal, or an alarm of the portable terminal or the like may be sounded.

Further, as another example of a business model, information on combinations of medical products which are dangerous when used simultaneously or combinations of components of medical products which are dangerous when used simultaneously (hereinafter referred to simply as combination information) is input to a terminal (Step 1). As described above, information on the object A is obtained by the reader/writer incorporated in the terminal (Step 2). Here, the object A is a medical product. The information on the object A includes information on components and the like of the object A. Next, as described above, information on the object B is obtained by the reader/writer incorporated in the terminal (Step 2'). Here, the object B is also a medical product. The information on the object B includes information on components and the like of the object B. In this way, information of a plurality of medical products is obtained. The combination information is compared to the obtained information of the plurality of objects, thereby determining whether a corresponding combination of medical products which are dangerous when used simultaneously is contained (Step 3). If the corresponding combination is contained, the user of the terminal is alerted (Step 4). If the corresponding combination is not contained, the user of the terminal is informed of the safety (Step 5). In Steps 4 and 5, in order to inform the user of the terminal of the information, the information may be displayed on the display portion of the terminal, or an alarm of the terminal or the like may be sounded.

As described above, by utilizing a semiconductor device of the present invention for a system, information can be obtained easily, and a system which realizes high performance and high added values can be provided.

This application is based on Japanese Patent application No. 2005-266122 filed on Sep. 13, 2005 with the Japanese Patent Office, the entire contents of which are hereby incorporated by reference.

What is claimed is:

1. A semiconductor device comprising:

an antenna; and at least a first integrated circuit and a second integrated circuit which are connected to the antenna, wherein:

the first integrated circuit includes a memory circuit which memorizes a first identification code and a first program for controlling an operation of the first integrated circuit, the second integrated circuit includes a memory circuit which memorizes a second identification code and a second program for controlling an operation of the second integrated circuit, the first identification code is different from the second identification code, and the first program is different from the second program.

2. The semiconductor device according to claim 1, wherein the antenna is formed over a different substrate from the first integrated circuit and the second integrated circuit.

3. The semiconductor device according to claim 1, wherein the antenna is a loop antenna or a spiral antenna.

4. The semiconductor device according to claim 1, wherein the first integrated circuit and the second integrated circuit are disposed to be overlapped with the antenna.

5. The semiconductor device according to claim 1, wherein the first integrated circuit and the second integrated circuit are disposed not to be overlapped with the antenna.

6. The semiconductor device according to claim 1, wherein the first integrated circuit and the second integrated circuit are not overlapped with the antenna and disposed inside a space surrounded by the antenna.

7. The semiconductor device according to claim 1, wherein each of the first integrated circuit and the second integrated circuit is an IC chip.

8. The semiconductor device according to claim 1, wherein each of the first integrated circuit and the second integrated circuit is formed over different substrates.

9. The semiconductor device according to claim 1, wherein each of the first integrated circuit and the second integrated circuit is connected to the antenna through a connection portion.

10. The semiconductor device according to claim 1, wherein each of the first integrated circuit and the second integrated circuit is connected to the antenna through a connection portion, and wherein the connection portion includes a first terminal which is connected to the antenna and a second terminal which is connected to one of the first integrated circuit and the second integrated circuit.

11. The semiconductor device according to claim 1, wherein one of the first program and the second program is a program regarding an unencrypted communication, and wherein the other of the first program and the second program is a program regarding an encrypted communication.

12. A semiconductor device comprising:

an antenna; and a plurality of integrated circuits which are connected to the antenna, wherein:

each of the plurality of integrated circuits includes a memory circuit which memorizes an identification code and a program for controlling an operation of the integrated circuit, the identification code is different in each of the plurality of integrated circuits, and the program is different in each of the plurality of integrated circuits.

13. The semiconductor device according to claim 12, wherein the antenna is formed over a different substrate from the plurality of integrated circuits.

14. The semiconductor device according to claim 12, wherein the antenna is a loop antenna or a spiral antenna.

15. The semiconductor device according to claim 12, wherein the plurality of integrated circuits are disposed to be overlapped with the antenna.

16. The semiconductor device according to claim 12, wherein the plurality of integrated circuits are disposed not to be overlapped with the antenna.

17. The semiconductor device according to claim 12, wherein the plurality of integrated circuits are not overlapped with the antenna and disposed inside a space surrounded by the antenna.

18. The semiconductor device according to claim 12, wherein each of the plurality of integrated circuits is an IC chip.

19. The semiconductor device according to claim 12, wherein each of the plurality of integrated circuits is formed over different substrates.

20. The semiconductor device according to claim 12, wherein each of the plurality of integrated circuits is connected to the antenna through a connection portion.

21. The semiconductor device according to claim 12, wherein each of the plurality of integrated circuits is connected to the antenna through a connection portion, and wherein the connection portion includes a first terminal which is connected to the antenna and a second terminal which is connected to one of the plurality of integrated circuits.

22. The semiconductor device according to claim 12, wherein one of the plurality of integrated circuits includes a memory circuit which memorizes a program regarding an unencrypted communication, and wherein the other of the plurality of integrated circuits includes a memory circuit which memorizes a program regarding an encrypted communication.

23. A semiconductor device comprising:

an antenna; and at least a first integrated circuit and a second integrated circuit which are connected to the antenna, wherein:

the first integrated circuit includes a memory circuit which memorizes a first identification code and a first program for controlling an operation of the first integrated circuit, the second integrated circuit includes a memory circuit which memorizes a second identification code and a second program for controlling an operation of the second integrated circuit, the first identification code is same as the second identification code, and the first program is same as the second program.

24. The semiconductor device according to claim 23, wherein the antenna is formed over a different substrate from the first integrated circuit and the second integrated circuit.

25. The semiconductor device according to claim 23, wherein the antenna is a loop antenna or a spiral antenna.

26. The semiconductor device according to claim 23, wherein the first integrated circuit and the second integrated circuit are disposed to be overlapped with the antenna.

27. The semiconductor device according to claim 23, wherein the first integrated circuit and the second integrated circuit are disposed not to be overlapped with the antenna.

28. The semiconductor device according to claim 23, wherein the first integrated circuit and the second integrated circuit are not overlapped with the antenna and disposed inside a space surrounded by the antenna.

29. The semiconductor device according to claim 23, wherein each of the first integrated circuit and the second integrated circuit is an IC chip.

30. The semiconductor device according to claim 23, wherein each of the first integrated circuit and the second integrated circuit is formed over different substrates.

31. The semiconductor device according to claim 23, wherein each of the first integrated circuit and the second integrated circuit is connected to the antenna through a connection portion.

32. The semiconductor device according to claim 23, wherein each of the first integrated circuit and the second integrated circuit is connected to the antenna through a connection portion, and wherein the connection portion includes a first terminal which is connected to the antenna and a second terminal which is connected to one of the first integrated circuit and the second integrated circuit.

33. The semiconductor device according to claim 23, further comprising a majority circuit which are connected the first integrated circuit and the second integrated circuit, wherein the majority circuit outputs the first identification code or the second identification code, and wherein the antenna outputs a carrier wave modulated in response to the identification code outputted from the majority circuit.

34. A semiconductor device comprising:

an antenna; and a plurality of integrated circuits which are connected to the antenna, wherein:

each of the plurality of integrated circuits includes a memory circuit which memorizes an identification code and a program for controlling an operation of the integrated circuit, and at least two integrated circuits selected from the plurality of integrated circuits have the same identification code and the same program.

35. The semiconductor device according to claim 34, wherein the antenna is formed over a different substrate from the plurality of integrated circuits.

36. The semiconductor device according to claim 34, wherein the antenna is a loop antenna or a spiral antenna.

37. The semiconductor device according to claim 34, wherein the plurality of integrated circuits are disposed to be overlapped with the antenna.

38. The semiconductor device according to claim 34, wherein the plurality of integrated circuits are disposed not to be overlapped with the antenna.

39. The semiconductor device according to claim 34, wherein the plurality of integrated circuits are not overlapped with the antenna and disposed inside a space surrounded by the antenna.

40. The semiconductor device according to claim 34, wherein each of the plurality of integrated circuits is an IC chip.

41. The semiconductor device according to claim 34, wherein each of the plurality of integrated circuits is formed over different substrates.

42. The semiconductor device according to claim 34, wherein each of the plurality of integrated circuits is connected to the antenna through a connection portion.

43. The semiconductor device according to claim 34, wherein each of the plurality of integrated circuits is connected to the antenna through a connection portion, and wherein the connection portion includes a first terminal which is connected to the antenna and a second terminal which is connected to one of the plurality of integrated circuits.

44. The semiconductor device according to claim 34, further comprising a majority circuit which are connected to the plurality of integrated circuits, wherein the majority circuit outputs the identification code which is a majority value of a plurality of identification codes, and wherein the antenna outputs a carrier wave modulated in response to the identification code outputted from the majority circuit.

* * * * *